US005595585A

United States Patent [19]

Aschenbeck et al.

[11] Patent Number: 5,595,585

[45] Date of Patent: Jan. 21, 1997

[54] LOW FREQUENCY SOUND DISTRIBUTION OF ROTARY FIBERIZER VEILS

[75] Inventors: David P. Aschenbeck; Michael T. Pellegrin, both of Newark, Ohio

[73] Assignee: Owens Corning Fiberglas Technology, Inc., Summit, Ill.

[21] Appl. No.: 236,061

[22] Filed: May 2, 1994

[51] Int. Cl.[6] ..... C03B 37/04

[52] U.S. Cl. ..... 65/505; 65/518; 65/526; 181/142

[58] Field of Search ..... 181/142; 65/305, 65/518, 526, 458

[56] References Cited

U.S. PATENT DOCUMENTS

| | | | |
|---|---|---|---|
| 2,897,874 | 12/1955 | Stalego . | |
| 2,931,076 | 4/1960 | Clark . | |
| 2,940,134 | 6/1960 | Heritage . | |
| 2,990,004 | 6/1961 | Sowers et al. . | |
| 3,030,659 | 4/1962 | Slayter | 65/526 |
| 3,477,103 | 11/1969 | Troth | 19/163 |
| 3,824,086 | 7/1974 | Perry et al. . | |
| 3,865,540 | 2/1975 | Loeffler . | |
| 3,981,708 | 9/1976 | Loeffler et al. . | |
| 4,167,404 | 9/1979 | Loeffler et al. . | |
| 4,263,033 | 4/1981 | Michalek | 65/526 |
| 4,266,960 | 5/1981 | Scott | 65/505 |
| 4,478,624 | 10/1984 | Battigelli et al. . | |
| 4,486,211 | 12/1984 | Monaghan . | |
| 4,517,915 | 5/1985 | Olsson et al. . | |
| 4,592,292 | 6/1986 | Olsson | 110/347 |
| 4,624,220 | 11/1986 | Olsson | 122/379 |
| 4,721,395 | 1/1988 | Olsson | 366/348 |
| 4,744,810 | 5/1988 | Battigelli et al. . | |
| 5,005,511 | 4/1991 | Olsson . | |
| 5,051,123 | 9/1991 | Nurmi . | |
| 5,109,948 | 5/1992 | Sandstrom . | |

*Primary Examiner*—John Hoffmann
*Attorney, Agent, or Firm*—C. Michael Gegenheimer; Curtis B. Brueske

[57] ABSTRACT

A method and device is disclosed for distributing a veil by applying low frequency sound to at least one portion of the veil, and causing the veil to deviate in its generally downward direction of travel. In its simplest embodiment, the lapping device of the present invention includes one low frequency sound generator having one resonator tube shaped for emission of low frequency sound and having an open end from which sound may be emitted to a portion of a veil. Preferably, the lapping device has two resonator tubes whose open ends are in spaced, opposing relationship, and in the preferred method low frequency sound is alternately applied at generally opposing locations near the veil, causing portions of the veil to deviate in generally alternate directions in its direction of travel.

17 Claims, 4 Drawing Sheets

LOW FREQUENCY SOUND DISTRIBUTION OF ROTARY FIBERIZER VEILS

TECHNICAL FIELD

This invention relates to wool materials of mineral fibers and, more specifically, to insulation products of long glass fibers. The invention also pertains to the manufacture of insulation products made of long wool fibers.

BACKGROUND OF THE INVENTION

Small diameter glass fibers are useful in a variety of applications including acoustical or thermal insulation materials. When these small diameter glass fibers are properly assembled into a lattice or web, commonly called a wool pack, glass fibers which individually lack strength or stiffness can be formed into a product which is quite strong. The glass fiber insulation which is produced is lightweight, highly compressible and resilient. For purposes of this patent specification, in using the terms "glass fibers" and "glass compositions", "glass" is intended to include any of the glassy forms of mineral materials, such as rock, slag and basalt, as well as traditional glasses.

The common prior art methods for producing glass fiber insulation products involve producing glass fibers from a rotary process. A single molten glass composition is forced through the orifices in the outer wall of a centrifuge or spinner, producing primarily straight glass fibers. The fibers are drawn downward by a blower, and conventional air knife and lapping techniques are typically used to disperse the veil. The binder required to bond the fibers into a wool product is sprayed onto the fibers as they are drawn downward. The fibers are then collected and formed into a wool pack. The wool pack is further processed into insulation products by heating in an oven, and mechanically shaping and cutting the wool pack.

Ideally, insulation products of glass fibers would have uniform spacing between fibers assembled in the lattice. Glass fiber insulation is basically a lattice which traps air between the fibers and prevents circulation of air to inhibit heat transfer. As well, the lattice also retards heat transfer by scattering thermal radiation. A more uniform spacing of fibers would maximize scattering and, therefore, have greater insulating capability.

In the production of wool insulating materials of glass fibers, it becomes necessary to use fibers that are relatively short to achieve desirable lattice properties. Known lapping techniques for dispersion of short fibers in a veil have provided acceptable, although not ideal fiber distribution. By contrast, long fibers tend to become entangled with each other, forming ropes or strings. For purposes of this patent specification, in using the terms "short fibers" and "long fibers" the term "short fibers" is intended to include fibers of approximately 2.54 centimeters (approximately 1 inch) and less, and "long fibers" are intended to include fibers longer than approximately 5.08 centimeters (approximately 2 inches).

Long fibers are more prone to entangle than short fibers, due, in part to their different aerodynamic properties, in addition to fiberizer throughput and geometry. Moreover, the longer they are, the more the long fibers tend to entangle. Conventional lapping techniques have failed to eliminate, and rather tend to enhance, formation of ropes and strings in veils of long or semi-continuous fibers. Even when undisturbed, veils of long fibers tend to form ropes and strings as the veil slows in its descent to the collection surface. Despite movement of the collection surface, long glass fibers (as do undisturbed veils of short fibers) tend to pile up into nonuniform packs of fibers, and unmanageable fiber accumulations. These nonuniform packs, characterized in part by roping and string formation, have long prevented significant commercial use of long fibers. The ropes of long fibers produce a commercially undesirable appearance and, more importantly, create deviation from the ideal uniform lattice and reduce the insulating abilities of the glass wool.

However, even short fibers that are straight form only a haphazard lattice, and some of the fibers lie bunched together. As a result, existing glass wool insulating materials continue to have significant non-uniformities in the distribution of fibers within the product. Thus, the ideal uniform lattice structure cannot be achieved.

A further problem presented by use of short straight fibers is the binder material necessarily added to the fibers to provide product integrity. Binder provides bonding at the fiber to fiber intersections in the lattice, but is expensive and has several environmental drawbacks. As most binders include organic compounds, great pains must be taken to process effluent from the production process to ameliorate the negative environmental impact of such compounds. Further, the binder must be cured with an oven, using additional energy and creating additional environmental cleanup costs. While long fibers display fiber to fiber entanglement even without binder, the nonuniformity of the resulting wool packs has long made them commercially undesirable.

Finally, in addition to the properties of uniformity and integrity, it is desirable for wool packs to exhibit recovery from compression. In the shipping and packaging of insulation products, high compressibility is preferred. It is desirable to compress the wool for shipping and then have it recover rapidly and reliably to the desired size. When the product is compressed, the binder holds firm at fiber to fiber intersections while the glass fibers themselves flex. If the stress upon the fiber increases due to excessive compression, the fiber breaks. Thus, current insulation products are limited in the amount of compression possible while still attaining adequate recovery.

Nonetheless, because long fibers are problematic in nearly all respects, commercial wool insulation products of glass fibers have long used only short straight fibers, despite the various drawbacks of short fibers in lattice non-uniformity, need for binder and related environmental concerns, and limited compressibility. Accordingly, the need remains for further improvements in wool insulation products to improve wool pack properties, reduce cost and eliminate environmental concerns.

SUMMARY OF THE INVENTION

The present invention satisfies the need for a method and device for moving veils of glass fibers which provide lapping of long fibers desired for more uniform distribution on a collection surface.

In accordance with the present invention, a method is disclosed for distributing a veil including gases and glass fibers produced by a rotary fiberizing apparatus which includes applying low frequency sound to at least one portion of said veil, and causing said veil to deviate in its generally downward direction of travel. The low frequency sound may also be referred to herein as infrasound, as the useful ranges of low frequency sound fall generally within and near the range associated with infrasound.

In one of the broadest aspects of the invention the low frequency sound is used to distribute a flow of fibers which can be of any type, either mineral fibers, polymer fibers or other types of fibers. The invention can also be used on a combined stream of two or more types of fibers, such as glass fibers and polymer fibers.

In its simplest embodiment, the lapping device of the present invention includes one low frequency sound generator having one resonator tube having an open end from which sound may be emitted. The resonator tube is shaped for emission of low frequency sound to a portion of a veil. Preferably, the lapping device has two resonator tubes with the open ends thereof in spaced, opposing relationship. Thus, in the preferred method, low frequency sound is alternately applied at generally opposing locations near the veil, causing portions of the veil to deviate in generally alternate directions in its direction of travel.

Unlike prior art lapping techniques which collapse and push the veil, it is believed that the present invention tends to induce motion of the veil in a field. That is, movement of gases is induced by the low frequency sound moving through the fibers, without adding compressive force thereto. As a result the veil and fibers therein tend to remain undisturbed as the veil moves. In addition, higher frequency lapping is possible by movement of the field with low frequency sound than with conventional air lappers. Such movement of the veil permits improved distribution of long fibers for various forms of collection.

As well, the entanglement possible with long fibers permits elimination of binder, if desired, along with related environmental costs. In addition, the present invention may further be used as a lapping device for veils of short fibers.

DETAILED DESCRIPTION OF THE PREFERRED EMBODIMENTS

The method and device 60 of the present invention may be used to move a veil 12 and thereby produce a more uniform distribution thereof on a collection surface 19.

Figure 1:
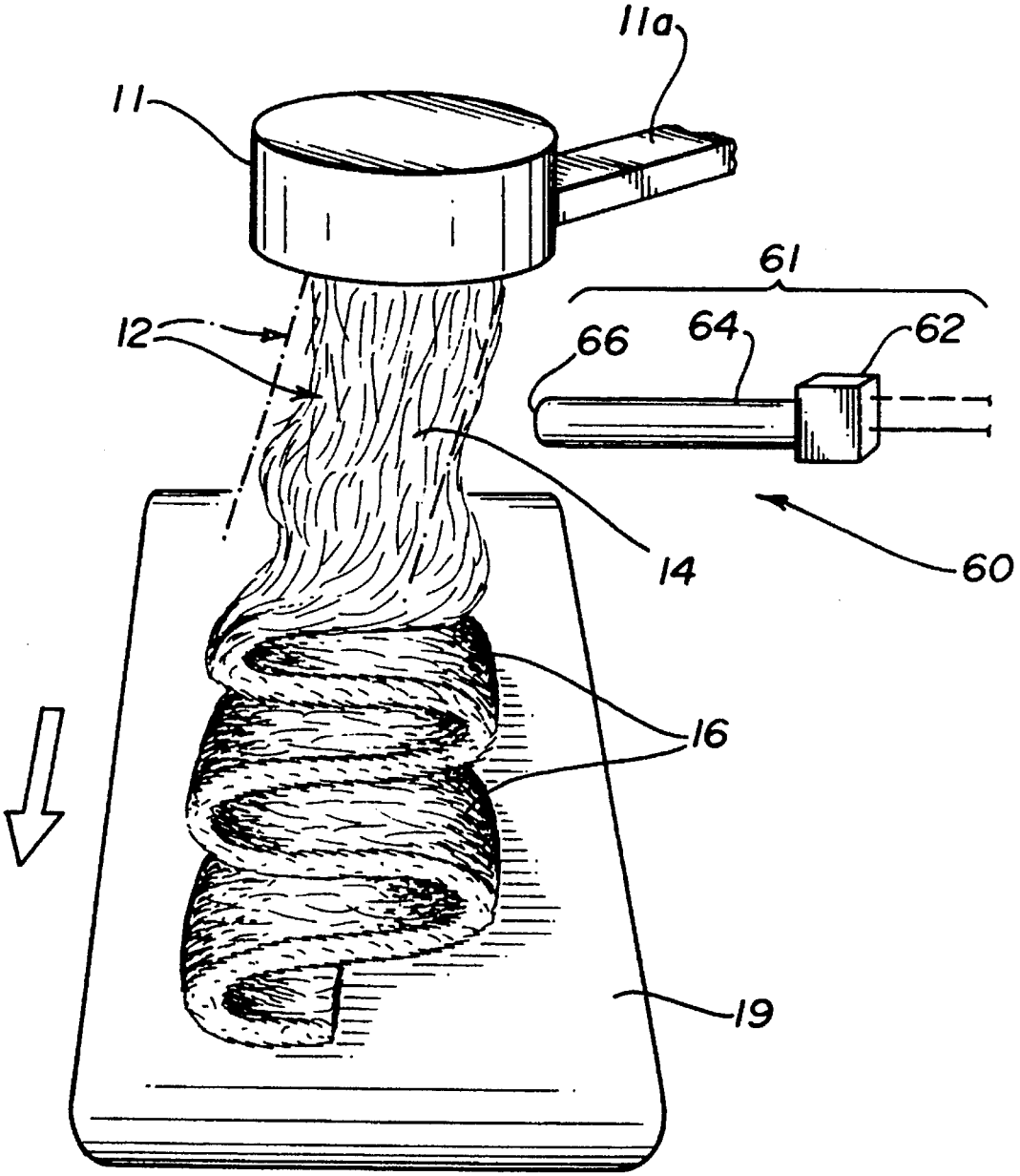
FIG. 1 is a schematic view in perspective of the method and lapping device of the present invention.
Figure 2:
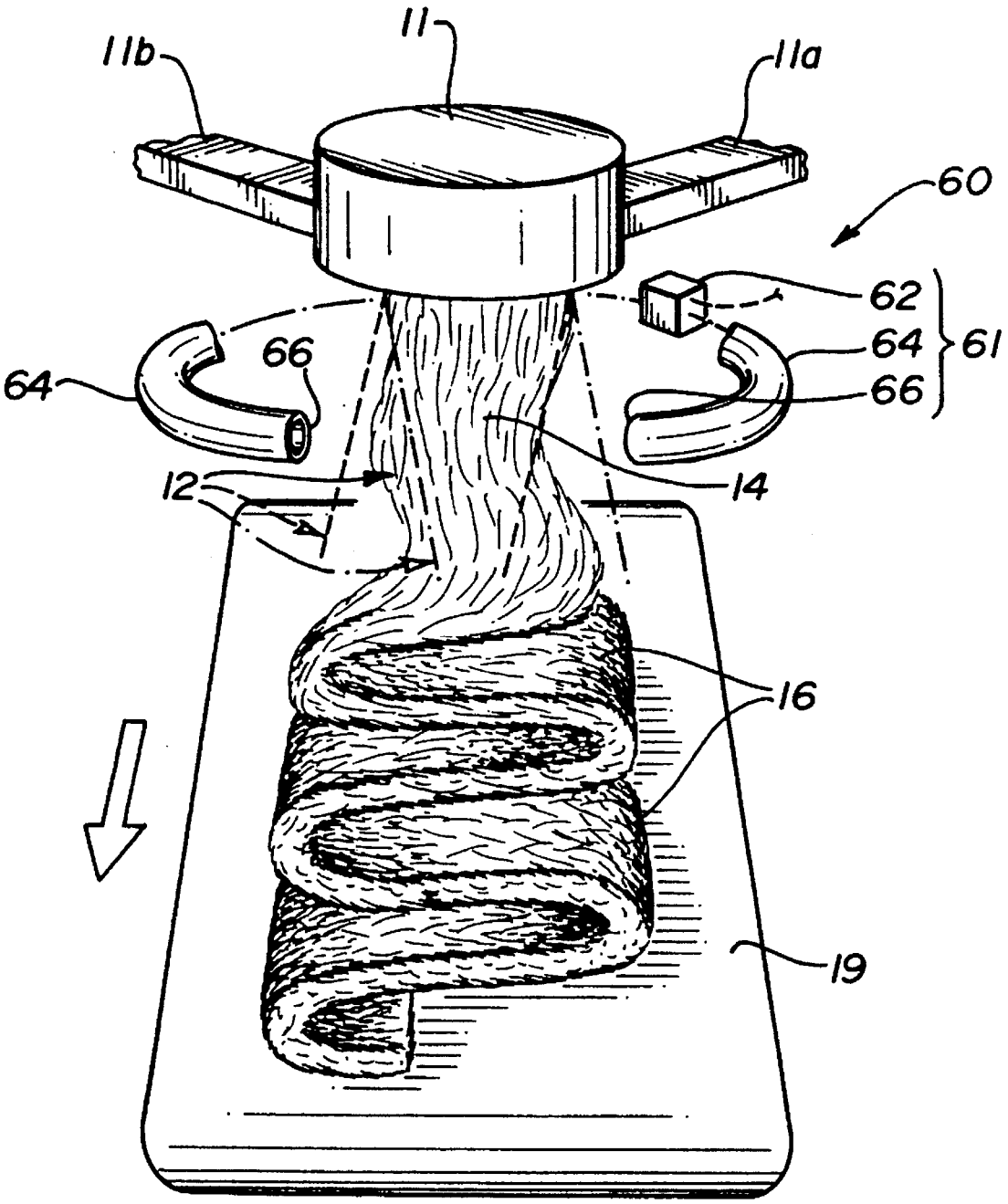
FIG. 2 is a schematic view in perspective of the preferred embodiment of the present invention.
Figure 3:
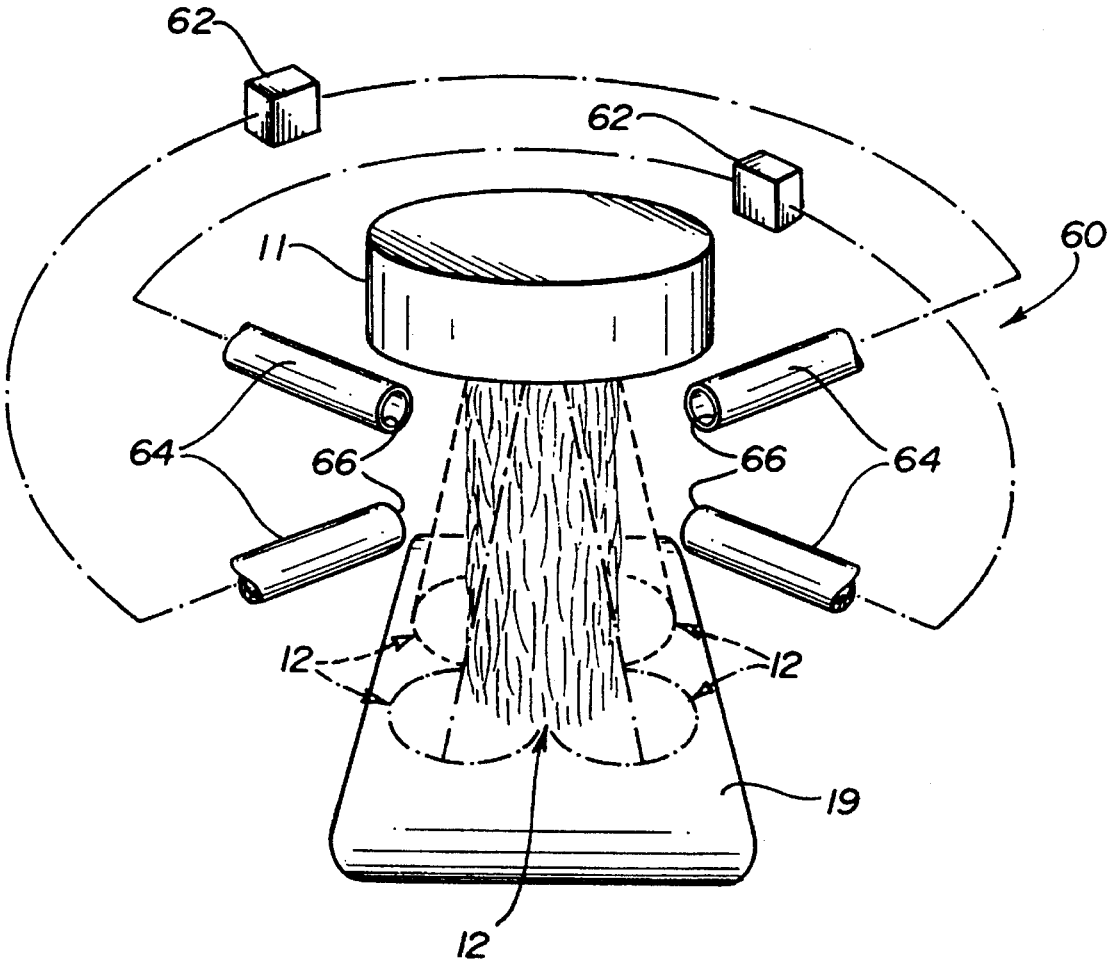
FIG. 3 is a schematic view in perspective of an alternate embodiment of the present invention.

FIGS. 1–3 show the present invention in various alternative embodiments. As may be seen in FIG. 1, a veil 12 including gases 14 and glass fibers 16 produced by a rotary fiberizing apparatus 11 is distributed by applying low frequency sound to at least one portion of the veil 12, and causing said veil 12 to deviate in its generally downward direction of travel. The useful ranges of low frequency sound (assumed to be produced at the resonant frequency of a device 60) may differ somewhat depending on the characteristics of the veil 12 being produced, so that some frequencies will produce motion of the veil 12, while others will produce somewhat less movement. Nonetheless, useful frequencies are generally in the range of 30 cycles per second or less. The preferred frequency for lapping a veil of glass fibers is about 15 cycles per second.

As well, the amount of force applied to the veil 12 may be varied by changing the amplitude of the feeder 62 to vary the energy in the low frequency sound. In practice, the air velocity field produced by the low frequency sound across the veil 12 is non-uniform due to the momentum and general downward motion of the veil, and the fact that the sound is not in a contained space where coupling between opposed tubes 64 is possible. Movement of the veil 12 deviates from the ideal uniform air velocity field between the tubes. Thus, in practice, some compressive force is applied to the veil 12 by the low frequency sound. However, the force may be reduced to essentially a non-compressive level, or may be increased to cause a partial collapse in the veil 12.

Figure 4:
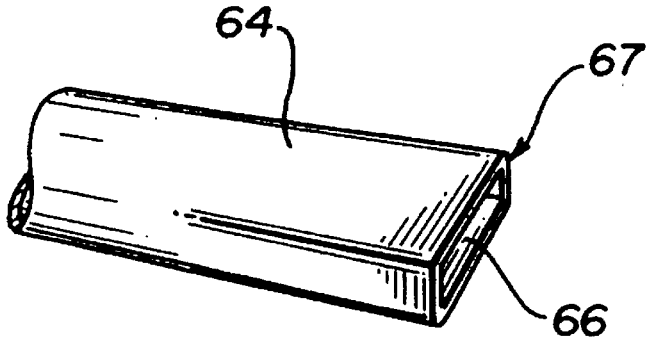
FIG. 4 is a schematic view in perspective of a transition piece for sound distribution at the open end of a resonator tube.

In the simplest embodiment of FIG. 1, the lapping device 60 of the present invention includes one low frequency sound generator 61 having one resonator tube 64 having an open end 66 from which sound may be emitted. The tube 64 has a length of $\lambda/4$, where $\lambda$ is the wavelength of the low frequency sound. The $\lambda/4$ length produces a standing wave in the tube 64, which results in a high pressure low air velocity node at the feeder end of the tube 64, and a low pressure, high air velocity node at the open end 66. The resonator tube 64 is also shaped for emission of low frequency sound to a portion of a veil 12, and may include a further sound distribution device 67, as shown in FIG. 4.

As understood in the field of infrasonics, the resonator tube 64 is substantially uniform in diameter, has a smooth surface, and bends are carefully made to convey the sound with minimal disturbance. The low frequency sound generator 61 also includes a feeder 62 which establishes the frequency of the sound produced. Feeders 62 typically use pressurized air and/or mechanical components to produce low frequency sound, as shown in U.S. Pat. Nos. 4,517,915, issued May 21, 1985 to Olsson et al., 5,005,511, issued Apr. 9, 1991 to Olsson et al., and 5,109,948, issued May 5, 1992 to Sandstrom. Low frequency sound generators are commercially available from Infrasonik AB, Stockholm, Sweden, the assignee of the patents noted, and may be used to produce low frequency sound in one or two resonator tubes 64. Connection to power and pressurized air lines is also provided as needed, as shown in FIGS. 1 and 2.

Referring now to FIG. 2, the preferred embodiment of the present invention is shown wherein the lapping device 60 has two resonator tubes 64 with the open ends 66 thereof in spaced, opposing relationship. Thus, in the preferred method, low frequency sound is alternately applied at generally opposing locations near the veil 12, causing portions of the veil 12 to deviate in generally alternate directions in its direction of travel. Although not preferred, the opposing resonator tubes 64 may be offset vertically, and the emission of low frequency sound electronically or mechanically synchronized to produce the desired effect. In this regard, some trial and error may be required for a particular vertical offset with dependency upon the characteristics of the veil 12. Although not preferred, two feeders 62 may be provided, one for each resonator tube 64 in an offset or other relationship, electronically synchronized and timed to provide the desired emission of low frequency sound.

Referring now to FIG. 3, an alternative embodiment is shown with at least one low frequency sound generator 61 and a plurality of resonator tubes 64 having open ends 66 from which low frequency sound may be emitted. The open ends are spaced generally equally around a veil 12. The plurality of resonator tubes 64 in one such embodiment may define a generally circular space between the open ends thereof through which a veil 12 may pass. However, other patterns surrounding the path of the veil 12 are possible.

The method of the present invention may, thus, include coordinating the emission of low frequency sound from a plurality of resonator tubes 64, causing portions of the veil 12 to deviate in different directions during its travel in a generally downward direction. Such an arrangement may be provided to vary the veil 12 motion in alternate directions as described, or in more than just alternating directions, for example, to create a circular motion, or to vary the motion depending on the nature of the collection surface 19 desired for a production run. Collection surfaces 19 may include generally horizontal, vertical or angled conveyors, alone or in pairs, or containers or sheets positioned to receive the veil 12. The collection surfaces 19 are preferably foraminous, and vacuum suction apparatus provided to remove gases from the veil 12.

Although the distance from the fiberizer may vary, the centerlines of the resonator tubes 64 at their open ends 66 may be as close as approximately 0.3 meters (12 inches) from the spinner of a rotary fiberizing apparatus 11, or even closer if the desired effect is achieved. Typically, the resonator tubes would vary in position from approximately 0.3 meters (12 inches) to approximately 1.22 meters (4 feet), but could be spaced further from the spinner if the desired effect is achieved.

Referring now to FIG. 4, the present invention preferably includes a transition piece 67 for distribution of low frequency sound emitted from at least one open end of a resonator tube 64. This piece serves to distribute the sound over a wider portion of the veil 12, rather than a circular portion, as would be the case where applied directly from the resonator tube 64. The transition piece 67 allows the low frequency sound to produce a more even motion in the veil 12. By way of example, not limitation, given a resonator tube 64 approximately 0.15 meters (6 inches) in diameter, a transition piece 67 could extend from the circular cross section a distance of approximately 0.33 meters (13 inches), gradually and smoothly, to the open end 66 which is rectangular in shape, approximately 0.28 meters (11 inches) wide by 0.07 meters (2.75 inches) high.

Figure 5:
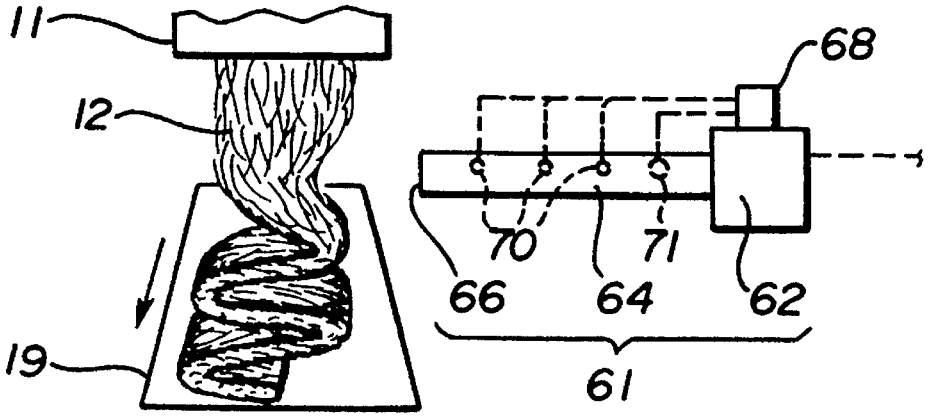
FIG. 5 is a block diagram showing a frequency control device in accordance with the present invention.

Further, referring now to FIG. 5, in accordance with the present invention, the low frequency sound generator 61 may include a frequency variation device 68 to vary the frequency of sound produced therewith. This is desirable where the temperature of the environment surrounding and affecting the low frequency sound generator 61 is variable. As noted in U.S. Pat. No. 4,517,915, the sound frequency and wavelength are interrelated according to $$f=c/\lambda$$

where f=the sound frequency c=the propagation rate of the sound wave, and

λ=the wavelength.

The resonator tube lengths are fixed, as is their diameter, and the appropriate length of the tube 64 to produce the low frequency sound is dependent on wavelength. As the air temperature changes, it is desirable to provide for frequency variation to produce the desired wavelength.

Thus, as further shown in FIG. 5, as a further feature of the present invention, the low frequency sound generator 61 includes a frequency variation device 68, such as an electrical controller or a mechanically adjusting element, or an element to vary the inlet of air pressure to the feeder 62, as well as a sensor to provide feedback to the frequency variation device. The sensor may be an air temperature sensor 70 or an array of temperature sensors 70 located in the resonator tubes 64, or a pressure sensor 71 located at the feeder end of the tube 64. As the temperature may vary over the length of tube 64, the signals from an array of temperature sensors may be averaged, or given a weighted average. The sensors 70 and 71 can be used separately or in combination to provide a signal to the frequency variation device 68 to variably control the frequency of sound produced by the low frequency sound generator 61. The frequency variation device 68 and sensors 70, 71 allow the generator 61 to adjust to the effects of temperature changes in the operating environment and maintain operation at the resonant frequency of the resonator tubes 64.

There is no intent to limit the present invention to the preferred embodiments described in detail herein. Rather, the present invention may be practiced with short or long fibers, straight or not, produced by conventional fiberizing techniques, whether the fibers are made of glass, other known fiber materials, or combinations thereof. Moreover, the present invention may be used to move such fibers whether they are produced in a veil or presented in other forming environments by other production techniques. However, the present invention is particularly suited to provide movement or lapping of veils 12 of long fibers, movement and lapping of which has long been problematic in the art. Preferably, the present invention is practiced with long, irregularly shaped fibers, such as the bi-component glass fibers and related fiberizing techniques disclosed in co-pending and commonly assigned U.S. patent application Ser. No. 08/148,098, filed Nov. 5, 1993, entitled DUAL-GLASS FIBERS AND INSULATION PRODUCTS THEREFROM, by Houpt et al, which is incorporated herein by reference. Bi-component fiberizing apparatus include molten glass feeding elements 11*a*, 11*b* for two separate glass types, as generally shown in FIG. 2, and molten glass types are combined in the fiberizing apparatus 11, as shown best in FIG. 2.

While certain representative embodiments and details have been shown for purposes of illustrating the invention, it will be apparent to those skilled in the art that various changes in the method and devices disclosed herein may be made without departing from the scope of the invention, which is defined in the appended claims.

We claim:

1. A fiber distribution device comprising a rotary fiberizing apparatus for generating a downwardly moving veil of glass fibers and gases traveling with the glass fibers, a collection surface, and a veil lapping device for applying sound to said veil to distribute it onto said collection surface, where said veil lapping device comprises a low frequency sound generator having a resonator tube having an open end from which sound may be emitted, wherein said resonator tube is shaped for directing low frequency sound having a frequency less than about 30 cycles per second to a portion of said veil.

2. The fiber distribution device of claim 1 in which said low frequency sound generator includes two of said resonator tubes shaped for emission of said low frequency sound, with each of said resonator tubes having one of said open ends, wherein said open ends thereof are positioned in a spaced, opposed relationship with respect to said veil.

3. The fiber distribution device of claim 1 including two of said low frequency sound generators, each of which includes one of said resonator tubes having one of said open ends, where each of said low frequency sound generators emits low frequency sound from said open ends of said resonator tubes, where said low frequency sound generators are electronically synchronized so that the emission of low frequency sound from one of said resonator tubes is in a timed relationship with the emission of low frequency sound from the other of said resonator tubes.

4. The fiber distribution device of claim 1 wherein said open end of said resonator tube includes a transition piece for distribution of low frequency sound emitted therefrom.

5. The fiber distribution device of claim 1 wherein said low frequency sound generator includes a frequency variation device to vary the frequency of sound produced by said low frequency sound generator.

6. The fiber distribution device of claim 1 wherein:

said low frequency sound generator includes a plurality of said resonator tubes, each of which has one of said open ends, with said open ends being spaced generally equally around said downwardly moving veil; and ; and said low frequency sound generator synchronizes the emission of low frequency sound from said open ends of said resonator tubes;

whereby said low frequency sound from said open ends of said resonator tubes causes portions of said downwardly moving veil to deviate in different directions.

7. A fiber distribution device comprising a rotary fiberizing apparatus for generating a downwardly moving veil of glass fibers and gases traveling with the glass fibers, a collection surface, and a veil lapping device for applying sound to said veil to distribute it onto said collection surface, where said veil lapping device includes at least one low frequency sound generator, each of which includes at least one resonator tube, each of said at least one resonator tubes having an open end from which sound may be emitted, wherein each of said at least one resonator tubes is shaped for directing low frequency sound having a frequency less than about 30 cycles per second to said veil.

8. The fiber distribution device of claim 7 including at least two of said low frequency sound generators, each of which includes one of said at least one resonator tubes, where said low frequency sound generators are electronically synchronized so that the emission of low frequency sound from one of said at least one resonator tubes is in a timed relationship with the emission of low frequency sound from at least one other of said at least one resonator tubes.

9. The fiber distribution device of claim 8 wherein:

said open ends of each of said at least one of said resonator tubes are spaced generally equally around said downwardly moving veil;

whereby said low frequency sound from said open ends of each of said at least one of said resonator tubes causes portions of said veil to deviate in different directions.

10. The fiber distribution device of claim 7 wherein at least one of said open ends of said at least one of said resonator tubes includes a transition piece for distribution of low frequency sound emitted therefrom.

11. The fiber distribution device of claim 7 wherein said at least one of said at least one low frequency sound generators includes a frequency variation device to vary the frequency of said sound.

12. The fiber distribution device of claim 11 wherein at least one of said open ends of said at least one resonator tube includes a transition piece for distribution of low frequency sound emitted therefrom.

13. A fiber distribution device comprising a rotary fiberizing apparatus for generating a downwardly moving veil of glass fibers and gases traveling with the glass fibers, a collection surface, and a veil lapping device for applying sound to said veil to distribute it onto said collection surface, where said the veil lapping device comprises a sound generator having a resonator tube having an open end from which sound may be emitted, wherein said resonator tube is shaped for directing sound to a portion of said veil.

14. The fiber distribution device of claim 13 in which the veil lapping device includes two of said resonator tubes shaped for emission of sound, with each of said resonator tubes having open ends, wherein said open ends thereof are positioned in a spaced, opposed relationship with respect to said veil.

15. The fiber distribution device of claim 13 in which the veil lapping device includes at least two of said resonator tubes shaped for emission of sound, with each of said resonator tubes having open ends, and in which said sound generator includes a feeder for each two of said resonator tubes, where each of said feeders emits sound from said open end of each of said resonator tubes, where the emission of sound from one of said at least two of said resonator tubes is in a timed relationship with the emission of sound from at least one other of said at least two of said resonator tubes.

16. The fiber distribution device of claim 13 wherein said open end of said resonator tube includes a transition piece for distribution of sound emitted therefrom.

17. The fiber distribution device of claim 13 wherein:

said veil lapping device includes a plurality of said resonator tubes, each of which has an open end spaced generally equally around said downwardly moving veil; ; and said sound generator synchronizes the emission of sound from said plurality of resonator tubes with respect to each other;

whereby sound from said plurality of resonator tubes causes portions of said veil to deviate in different directions during its travel in a generally downward direction.

* * * * *